US005872327A

United States Patent [19]

Taal et al.

[11] Patent Number: 5,872,327

[45] Date of Patent: Feb. 16, 1999

[54] SUBCALIBER, SPIN STABILIZED MULTI-PURPOSE PROJECTILE

[75] Inventors: Cornelis Taal, BL Erp, Netherlands; Bernhard Bisping, Ratingen, Germany; Ulrich Theis, Mülheim, Germany; Michaed Vagedes, Köln, Germany; Siegfried Kessler, Düsseldorf, Germany

[73] Assignee: Rheinmetall Industrie Aktiengesellschaft, Dusseldorf, Germany

[21] Appl. No.: 377,286

[22] Filed: Jun. 23, 1989

[30] Foreign Application Priority Data

Jun. 25, 1988 [DE] Germany ..... 38 21 474.1

[51] Int. Cl.[6] ..... F42B 12/00; F42B 12/72

[52] U.S. Cl. ..... 102/506; 102/517; 419/47; 75/248

[58] Field of Search ..... 102/491, 501, 102/506, 517, 518, 519, 398; 419/47; 75/248

[56] References Cited

U.S. PATENT DOCUMENTS

| | | | |
|---|---|---|---|
| 4,032,335 | 6/1977 | Zapf et al. | 102/496 |
| 4,108,072 | 8/1978 | Trinks et al. | 102/518 |
| 4,108,073 | 8/1978 | Davis | 102/518 |
| 4,458,599 | 7/1984 | Mullendore et al. | 102/517 |
| 4,643,099 | 2/1987 | Luther et al. | 102/517 |
| 4,665,828 | 5/1987 | Auer | 102/519 |

FOREIGN PATENT DOCUMENTS

| | | |
|---|---|---|
| 0051375 | 5/1982 | European Pat. Off. . |
| 0073384 | 3/1983 | European Pat. Off. . |
| 0073385 | 3/1983 | European Pat. Off. . |

*Primary Examiner*—Harold J. Tudor
*Attorney, Agent, or Firm*—Venable; George H. Spencer; Norman N. Kunitz

[57] ABSTRACT

A sub-caliber, spin stabilized multi-purpose projectile (FAPDS) made of a liquid phase sintered heavy metal sintered material composed essentially of metallic tungsten powder with additives of cobalt and nickel. To attain the highest final ballistic performance in lightly armored air and ground targets (e.g. aircraft, helicopters, armored personnel carriers) the present invention provides that the tungsten percentage of the projectile body lies between 90 and 99.5 weight percent, the density of the sintered material lies between 17.5 and 19.2 g/cm$^3$ and the ratio of cobalt to nickel in the binder phase lies between 1:0.5 and 1:2.3, preferably 1:1.5. The projectile body according to the preferred embodiment of the invention is made of one piece and includes in its front portion a cylindrical pin for fastening of a projectile tip made of heat treatable steel. While ensuring stability during loading and firing, the projectile exhibits a highly sensitive, brittle matrix which develops in the sintered material only after the appropriate thermal treatment so that the projectile body, upon impact on the target, completely disintegrates upon encountering the slightest resistance and develops an optimum fragmentation effect.

20 Claims, 3 Drawing Sheets

SUBCALIBER, SPIN STABILIZED MULTI-PURPOSE PROJECTILE

BACKGROUND OF THE INVENTION

The present invention relates to a sub-caliber, spin stabilized multi-purpose FAPDS (frangible armor piercing discarding sabot) projectile wherein the projectile, due to its material structure, completely disintegrates into fragments when it impacts on a target and encounters even the slightest resistance in the target such as, for example, from thin-walled aluminum plates, and with the projectile including a projectile body composed of a liquid phase sintered heavy metal sintered material composed essentially of metallic tungsten powder with additives.

In order to produce the highest possible kinetic energy with a correspondingly high fragmentation effect in the target, such multi-purpose projectiles (FAPDS projectiles) in a caliber range from about 20 to 50 mm should have a high material density and are intended to be used in individual rounds and preferably in continuous fire against air targets (e.g. fast flying aircraft, armored combat helicopters) as well as against fast moving ground targets (e.g. armored personnel carriers). Depending on the caliber, the energy of the projectile is sufficient to penetrate even armor plates up to a thickness of about 60 mm. The projectile is composed of a brittle heavy metal free of explosives and is to have a lateral effect similar to an explosive projectile in that the projectile body, upon impact, for example, on the first target plate of a multi-plate target, disintegrates into fragments and, due to its high kinetic energy, not only produces a good lateral effect but also a distinct depth effect.

Such a type of FAPDS multi-purpose projectile is disclosed, for example, in European Patent Application No. 0,073,385, published Mar. 3rd, 1983. The projectile body of this prior art multi-purpose projectile is constructed of several parts and is composed of various tungsten materials. A conical front section, may have the same composition as a center rump section or may be composed, at least in part, of another material having a lower density such as, for example, aluminum or ceramic. The rear tail section should be easily workable by machine and is therefore composed of a tungsten heavy metal alloy having a density of at least 16.7 g/cm$^3$. The individual components of the projectile are reported to be soldered or welded together. Therefore, the manufacture of the individual projectile components of various tungsten materials is very expensive and requires additional process steps to connect the individual parts together in a manner that withstands firing. This type of projectile having a relatively low material density does not exhibit the best fragmentation behavior, and it no longer meets the very stringent requirements of today. In this prior art multi-part projectile body configuration, the rear tail section does not already disintegrate when it hits the first, thin metal target sheets such as, for example, the outer walls of an aircraft. Thus the best possible laterally effective fragmentation mass is not realized.

SUMMARY OF THE INVENTION

It is an object of the present invention to provide a multi-purpose projectile of the above type which is stable during loading in cadenced firing from automatic weapons, which has the strength to withstand the firing process of each individual projectile, and which ensures optimum fragmentation behavior as a result of the structure of its material even if the projectile impacts on the thinnest aluminum plates and, as a result, maximum performance in all types of targets mentioned above. Additionally, such a projectile should be economical to produce with respect to material processing and working to attain its final projectile shape.

The above object is achieved according to the present invention by a subcaliber, spin stabilized multi-purpose projectile which, due to its given material structure, already completely disintegrates into fragments when it impacts on the target and encounters even the slightest resistance in the target such as, for example, from thin-walled aluminum plates, wherein the projectile includes a projectile body composed of a liquid phase sintered heavy metal sintered material composed essentially of metallic tungsten powder with additives of nickel and cobalt; and wherein:

(a) the tungsten percentage in the sintered material lies between 90 and 99.5 weight percent, preferably between 97 and 99 weight percent;

(b) the percentage ratio of cobalt to nickel in the sintered material of the raw composition lies between 1:0.5 and 1:2.3, preferably at about 1:1.5; and (c) the density of the sintered material lies between 17.5 and 19.2, preferably between 18.5 and 19.0 g/cm3;

(d) the heavy metal sintered material has an average grain size between 20 and 50 $\mu$m, preferably about 40 $\mu$m; and (e) the hardness of the projectile body of the heavy metal sintered material lies between 300 and 400 HV(30), preferably between 340 and 380 HV(30).

The excellent final ballistic performance, i.e. the transfer of the greatest amounts of kinetic energy due to the immediate disintegration of the projectile body with optimum fragment formation as soon as the first resistance by the target structure in question is encountered, is realized very substantially by the high density between 17.5 and 19.2 g/cm$^3$ of the one-piece projectile body. The optimum fragmentation behavior is realized by the great brittleness of the heavy metal sintered material and by the special ratio of cobalt to nickel in the binder phase (matrix) between the individual tungsten granules. The special characteristics of the projectile body are further realized by mutually adapted heat treatments and the stated features of a grain size from 20 to 50 $\mu$m (micrometer), preferably about 40 $\mu$m, and a hardness between 300 and 400 HV(30), preferably between 340 and 380 HV(30).

According to the method of manufacturing the multi-purpose projectile bodies according to the invention, the fine-grained tungsten powder starting material (grain size smaller than 100 $\mu$m) is mixed with additives up to 10 weight percent, preferably about 1 to 3 weight percent, of a cobalt-nickel mixture as the binder phase and the mixture is sintered, for example in a suitable push-through furnace at temperatures around approximately 1450° to 1600° C., preferably at about 1580° C., in the liquid phase of the matrix (binder phase) composed of cobalt, nickel and dissolved tungsten for between 5 and 90 minutes, preferably 15 to 30 minutes. Liquid phase sintering for about 15 to 30 minutes permits a uniformly high compaction of the metal powders and the necessary alloying of sufficient quantities of tungsten in the Co/Ni binder matrix. Only after the percentage of dissolved tungsten in the binder matrix has reached more than about 40%, is it possible for the desired metal phases disclosed and discussed below to develop.

After the liquid phase sintering process, a projectile blank results which is easy to work or machine, possibly after further thermal treatment. After working, the projectile is subjected to a heat treatment taking about 1 to 20 hours, preferably about 10 hours, at a temperature of about 900° to 1200° C., preferably at about 1000° to 1100° C., to make the matrix brittle. Only during this later heat treatment is the desired binder phase, which is composed of at least two and preferably three different phases, set.

The desired brittleness of the tungsten sintered material in the binder matrix can be positively set by way of a suitable ratio of cobalt to nickel and liquid phase sintering with suitable temperature control of a given duration to cause the above mentioned required percentage of tungsten to go into solution.

According to the preferred embodiment of the invention, the projectile includes a subcaliber, spin stabilized projectile body composed of a liquid phase sintered heavy metal sintered material composed essentially of metallic tungsten powder with additives, e.g. nickel and cobalt, wherein:

the projectile body composed of heavy metal sintered material is made of one piece and includes a cylindrical center region, a slightly conically tapered tail region and a conically tapered nose region which ends in a circular frontal end surface which extends at a right angle to the longitudinal axis of the projectile and which is provided with an essentially cylindrical forwardly oriented pin in its center, the pin is provided with a circumferential annular groove, as an intended break location, in close proximity to the circular front end surface; and a conical tip, preferably made of heat treatable steel, is fastened to the pin.

DETAILED DESCRIPTION OF THE INVENTION

Figure 1:
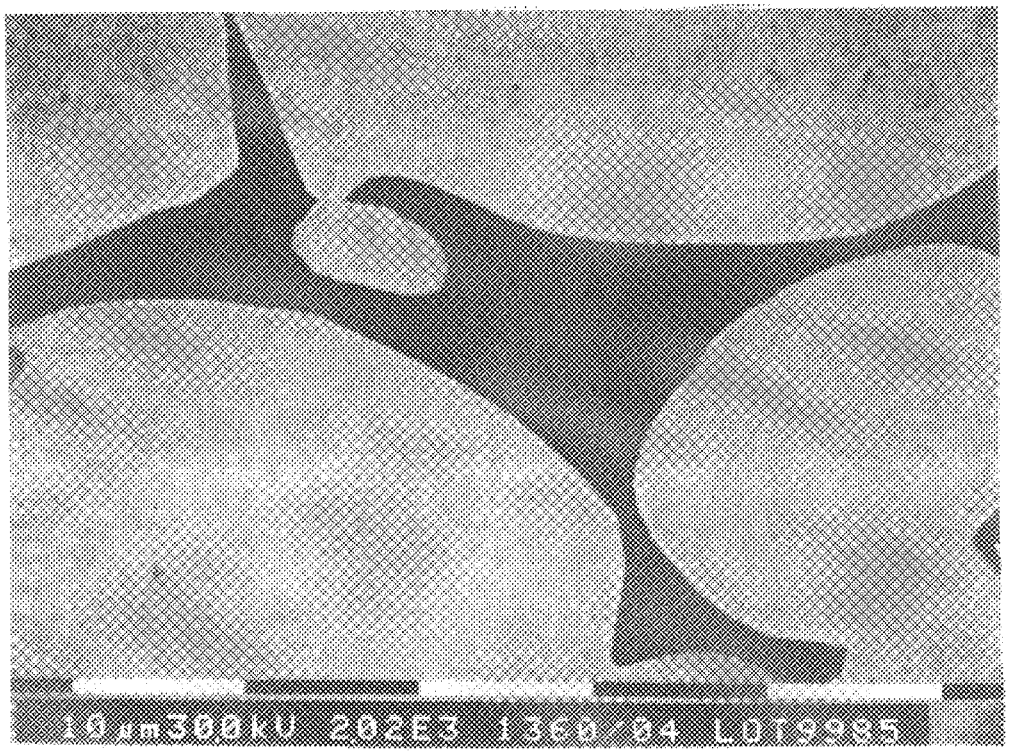
FIG. 1 is a microphotograph showing the binder matrix between tungsten granules of a liquid phase sintered material formed according to the method of the invention with a Co/Ni ratio of 1:0.5.

As mentioned above, a subcaliber, spin stabilized multipurpose projectile according to the invention, includes a projectile body composed of a liquid phase sintered heavy metal sintered material composed essentially of metallic tungsten powder with additives of nickel and cobalt, and which due to its material structure, already completely disintegrates into fragments when it impacts on the target and encounters even the slightest resistance in the target such as, for example, from thin-walled aluminum plates. For this purpose, the material of the projectile body according to the invention is characterized by the following features:

(a) the tungsten percentage in the sintered material lies between 90 and 99.5 weight percent, preferably between 97 and 99 weight percent;

(b) the percentage ratio of cobalt to nickel in the sintered material of the raw composition lies between 1:0.5 and 1:2.3, preferably at about 1:1.5;

(c) the density of the sintered material lies between 17.5 and 19.2, preferably between 18.5 and 19.0 g/cm$^3$;

(d) the heavy metal sintered material has an average grain size between 20 and 50 $\mu$m, preferably about 40 $\mu$m; and (e) the hardness of the projectile body formed of the heavy metal sintered material lies between 300 and 400 HV (30), preferably between 340 and 380 HV(30).

As further mentioned above, the excellent final ballistic performance is realized very substantially by the high density between 17.5 and 19.2 g/cm$^3$ of the projectile body (which is formed in one-piece), while the optimum fragmentation behavior is realized by the great brittleness of the heavy metal sintered material and the special ratio of cobalt to nickel in the binder phase (matrix) between the individual tungsten granules. Moreover, the desired brittleness of the tungsten sintered material in the binder matrix can be positively set by a suitable ratio of cobalt to nickel and the liquid sintering with suitable temperature control of a given duration to cause the required percentage of tungsten, i.e. above 40 percent, to go into solution. The following are examples showing the effects of different cobalt to nickel ratios for projectiles formed by the process according to the present invention.

EXAMPLE I

CO/Ni ratio=1:0.5

With the indicated Co/Ni ratio, the binder matrix between the individual tungsten granules is composed of a highly brittle metallic $\mu$ phase (M$\mu$ phase), e.g. $(NiCo)_7W_6$, having a rhombohedral lattice structure as shown in FIG. 1. The structure of this tungsten sintered material is already so brittle that a projectile produced therefrom possibly (partially) does not have sufficient stability during the firing process.

EXAMPLE II

Co/Ni ratio=1:2.3

Figure 2:
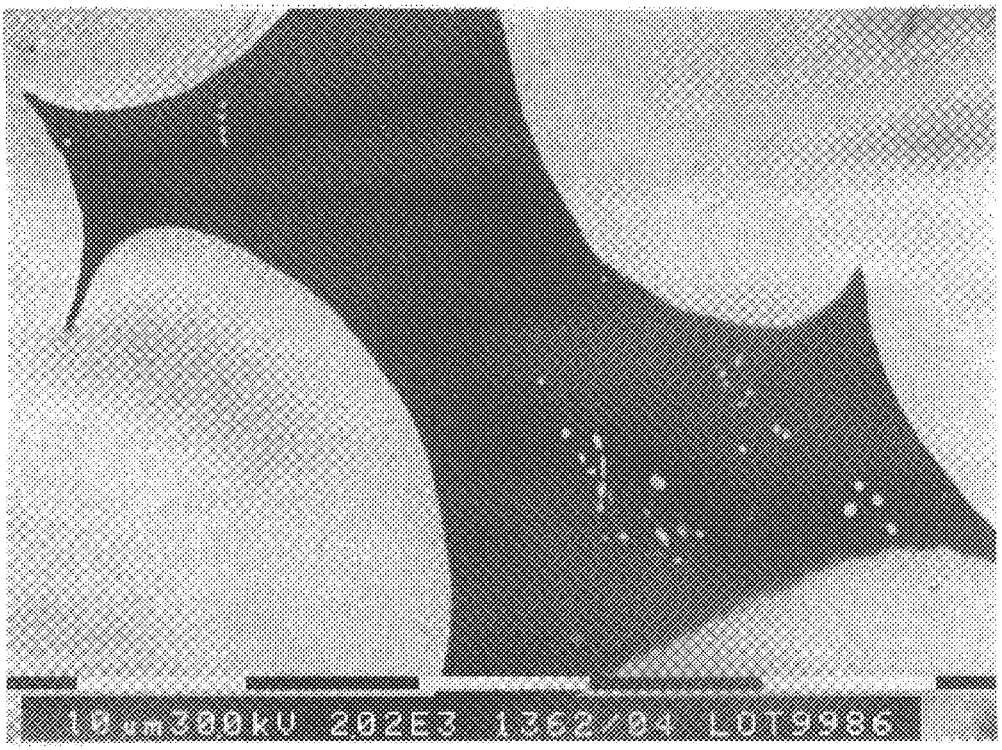
FIG. 2 is a microphotograph showing the binder matrix between tungsten granules of a liquid phase sintered material formed according to the method of the invention with a Co/Ni ratio of 1:2.3.

With this cobalt to nickel ratio, the binder matrix is composed of a 100% face-centered cubic $\gamma$ phase (gamma phase), e.g. an NiCoW mixed crystal including fine tungsten precipitates as can be seen in FIG. 2. This material is so tough that, when encountering thin aluminum target plates (outer walls of aircraft) there still is not sufficient disintegration with the correspondingly great fragment formation.

EXAMPLE III

Co/Ni ratio=1:1.2

Figure 3:
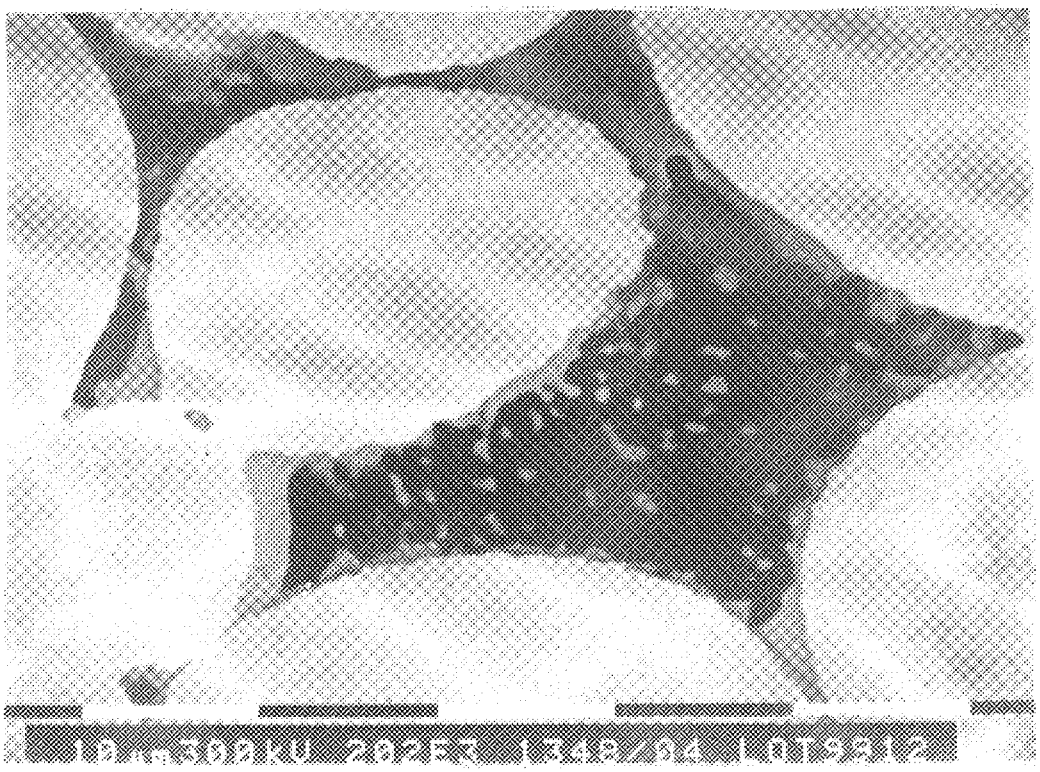
FIG. 3 is a microphotograph showing the binder matrix between tungsten granules of a liquid phase sintered material formed according to the method of the invention with a Co/Ni ratio of 1:1.2.

As can be seen in FIG. 3, the binder phase when using this ratio contains three different metal phases: firstly, a light-gray brittle phase having a rhombohedral lattice structure (same as binder phase of Example I); secondly, dark-gray needles of a hexagonal $\beta$ phase (beta phase), e.g. $(NiCo)_3W$; and thirdly a very dark face-centered cubic $\gamma$ phase (as in Example II). The three individual phases are composed of different compositions of Co/Ni/W. This alloy is highly brittle and requires an appropriate projectile structure (which will be described in detail below) to ensure reliable disintegration when impacting on thin aluminum sheets.

EXAMPLE IV

Co/Ni ratio=1:1.5

Figure 4:
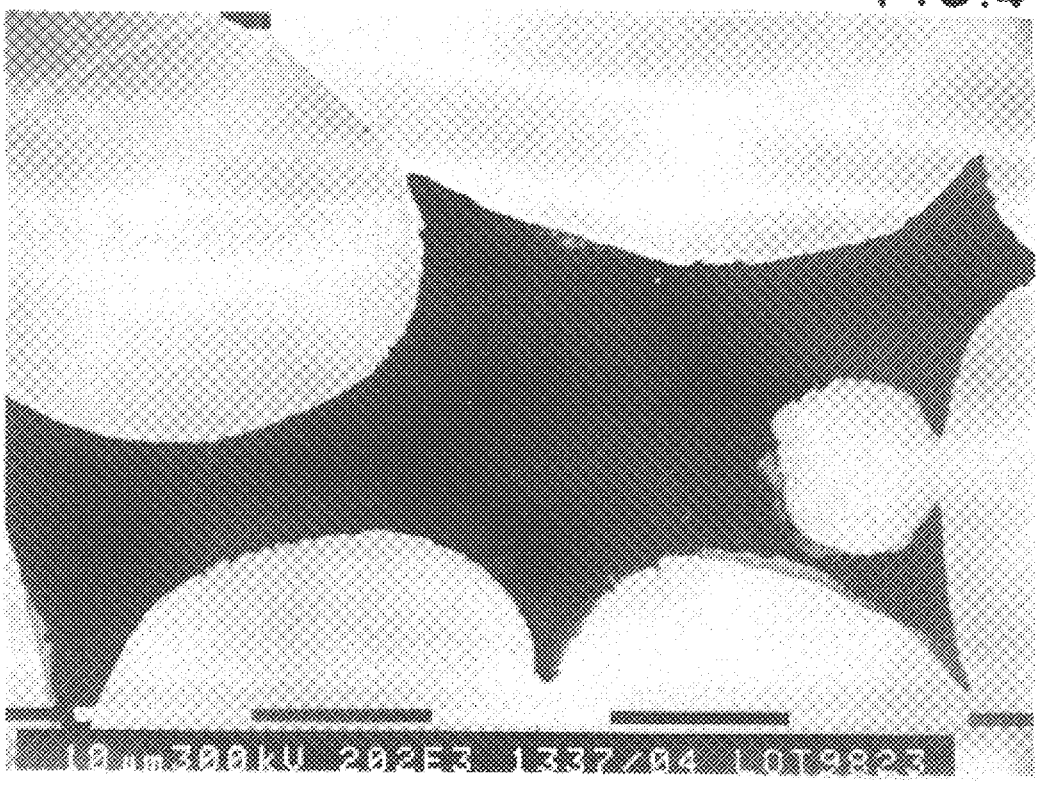
FIG. 4 is a microphotograph showing the binder matrix between tungsten granules of a liquid phase sintered material formed according to the method of the invention with a Co/Ni ratio of 1:1.5.

With this cobalt to nickel ratio, and as can be seen in FIG. 4, only very small quantities of the brittle $\mu$ phase are present in the lattice, and the β phase (dark gray needles) and the dark γ phase are formed approximately to the same extent. This tungsten heavy metal alloy exhibits excellent fragmentation behavior in the target and has the best stability during loading when employed in automatic weapons and the best strength during the firing process. This material composition provides the optimum solution provided according to the invention, and is the preferred composition.

The method of producing the FAPDS projectile body according to the invention is based on a composition of the fine grained raw mixture of from about 0.5 to 10 weight percent of a cobalt-nickel mixture of the desired ratio, e.g. 98 weight percent tungsten powder and 2 weight percent of the cobalt/nickel binder phase. This material is shaped into a projectile blank and is liquid phase sintered. The liquid phase sintering is preferably performed in a hydrogen protective gas atmosphere at a temperature between 1450° and 1600° C., preferably at about 1580° C., for a time period between 5 and 90 minutes, preferably between 15 and 30 minutes. Thereafter, the metal binder phase (matrix) between the pure tungsten granules has a composition of more than 40% dissolved tungsten, 20 to 25% cobalt and 30 to 40% nickel. The sintered projectile blank can then be very easily worked to its final dimensions without requiring any further thermal and/or additional mechanical treatments. If necessary, however, a solution heat treatment may be effected to improve workability. In the latter case, the finished sintered projectile body is subjected to a heat treatment at a temperature between 1200° and 1400° C., preferably between 1300° and 1370° C., and is held at the respective heat treatment temperature for a time period from 0.5 to 6 hours, preferably between 2 and 4 hours, and then is quenched quickly.

After finish working, e.g., machining of the projectile body, the body is subjected to a final embrittlement heat treatment, preferably in a vacuum of about $10^{-5}$ Torr, with three separate, homogeneous metal phases developing in the binder phase (see FIGS. 3 and 4). This final heat treatment is carried out at a temperature between 900° and 1200° C., preferably between 1000° and 1100° C., for a period of time from 1 to 20 hours, preferably about 10 hours. Following this treatment, the tungsten granules having grain sizes of about 20 to 50 μm are almost completely bound into a highly tungsten containing phase with up to about 85 weight percent of dissolved tungsten, with this highly tungsten containing phase between the pure tungsten granules having at least two different homogeneous phases of different tungsten, nickel and cobalt content. The described tungsten heavy metal alloys according to the invention are excellently suited for any desired projectile shapes or structures for the purpose of providing optimum fragmentation behavior in the target. That is, the material is not bound to any special projectile shape. However, the best results can be attained with the preferred projectile shape shown in FIGS. 5 and 6.

Figure 5:
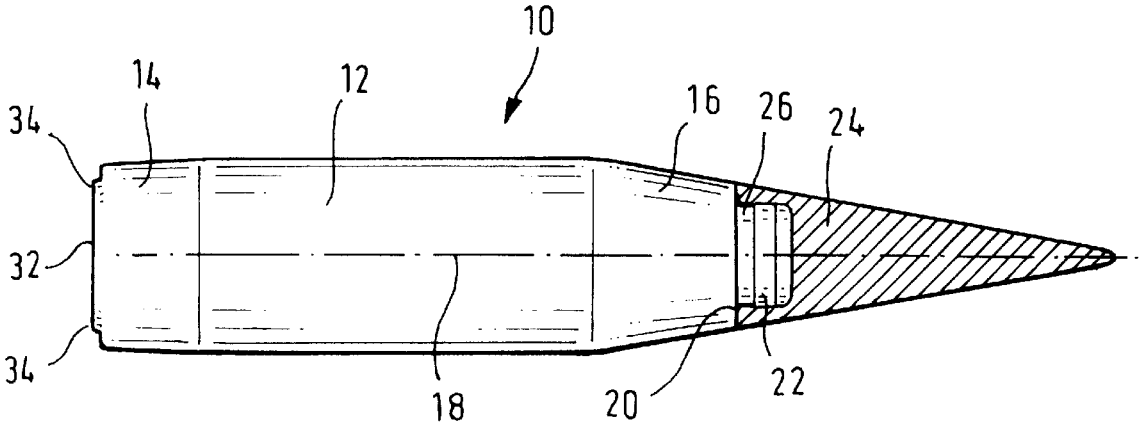
FIG. 5 is a side view, partially in section, of a preferred embodiment of a projectile according to the invention.
Figure 6:
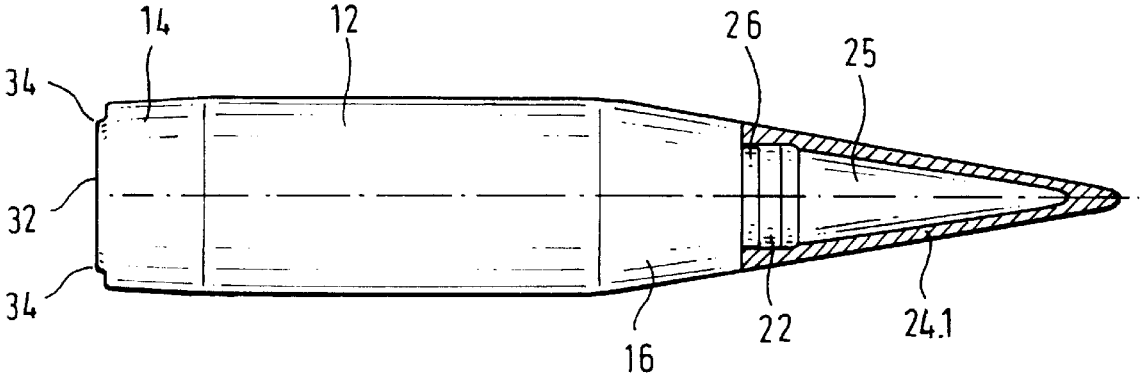
FIG. 6 is a side view, particularly in section, showing a modification of the preferred embodiment of FIG. 5.

According to FIGS. 5 and 6, the preferred embodiment of the projectile includes a one piece projectile body 10, which is composed of a liquid phase sintered metal tungsten powder according to the invention including the Co/Ni W composite matrix, and which is provided with a conical nose tip member 24. The projectile body 10 has a cylindrical center region 12, a slightly rearwardly conically tapered tail region 14 and a forward conically tapered nose region 16 which transitions into the tip member 24. This one piece projectile body 10 may be provided with a bore (not shown) in its tail to accommodate a tracer set.

As shown, the conically tapered nose region 16 is truncated and ends in pin 22 which projects, in the form of a cylinder, from a planar, circular front end surface 20 which extends perpendicular to the longitudinal axis 18 of the projectile. The pin 22, which extends to approximately one half of the conically tapered front end portion of the projectile and has a diameter which is greater than the radius of the surface 20 and is about one half of the maximum diameter of the projectile body 10, is provided for fastening the body 10 to the nose tip member 24 which in FIG. 5 is solid and composed of heat treatable steel. In close proximity to the surface 20, the pin 22 is provided with a circumferential annular groove 26 which serves as an intended break location for the projectile. At its rearwardly slightly conically tapered tail section 14, the projectile body 10 is provided with a planar standing surface 32 in which, for better transfer of spin from the propelling cage bottom to the projectile body, two or more cam-like steps or projections 34 may be provided.

In a second modified embodiment, shown in FIG. 6, the nose tip member 24.1 of heat treatable steel is hollow and is provided with an incendiary substance 25 within the resulting cavity. This substance 25 is provided to improve the pyrophoric incendiary effect of the projectile in a target.

The FAPDS multi-purpose projectile according to the present invention, with the above-described composition of materials and having the shown projectile body configuration with the heat treatable steel tip, meets the contradictory requirements, on the one hand, for absolutely reliable stability during cadenced supplying (loading and unloading at the highest velocity and deceleration values) as well as reliable strength during the firing process and, on the other hand, the high sensitivity of the projectile fragmentation behavior upon impact against the smallest target resistances connected with economical and good workability in an optimum manner.

In spite of the brittle projectile material, the shattering encountered in connection with the prior art projectiles manufactured of conventional tungsten carbide does not occur with the projectile structure according to the present invention.

The excellent performance in the target of the projectile according to the invention is particularly evident from the fact that, in addition to the large holes in the target structures produced by cumulative fragmentation effects, the tungsten heavy metal material according to the present invention additionally produces numerous smaller holes having a diameter of about 1 to 3 mm next to or along the edges of the large holes to thus develop a sufficiently destructive effect (e.g., on electronic devices in the interior of a combat helicopter) even at a greater target depth. This is based on the high disintegratability of the projectile already when encountering the first, thin target sheet metal with a laterally effective fragmentation mass which is greater by about 30% to 40% compared to the above-described prior art projectile and develops a correspondingly better performance in the target.

The invention now being fully described, it will be apparent to one of ordinary skill in the art that any changes and modification can be made thereto without departing from the spirit or scope of the invention as set forth herein.

What is claimed:

1. A subcaliber, spin stabilized multi-purpose projectile which, due to its material structure, completely disintegrates into fragments when it impacts on a target and encounters even the slightest resistance in the target, said projectile including a projectile body composed of a liquid phase sintered heavy metal sintered material composed essentially of metallic tungsten powder with additives of nickel and cobalt; and wherein:

(a) the tungsten percentage in the sintered material lies between 90 and 99.5 weight percent;

(b) the percentage ratio of cobalt to nickel in the sintered material of the raw composition lies between 1:0.5 and 1:2.3;

(c) the density of the sintered material lies between 17.5 and 19.2 g/cm$^3$;

(d) the heavy metal sintered material has an average grain size between 20 and 50 $\mu$m; and (e) the hardness of the projectile body produced from the heavy metal sintered material lies between 300 and 400 HV(30).

2. A multipurpose projectile as defined in claim 1 wherein: the tungsten percentage in the sintered material lies between 97 and 99 weight percent; the percentage ratio of cobalt to nickel in the sintered material of the raw composition lies between about 1:1.2 and 1:1.5; and the density of the sintered material lies between 18.5 and 19.0 g/cm$^3$.

3. A multipurpose projectile as defined in claim 2 wherein the percentage ratio of cobalt to nickel in the sintered material is about 1:1.5.

4. A multipurpose projectile as defined in claim 2 wherein the heavy metal sintered material has an average grain size of about 40 $\mu$m and a hardness of between 340 and 380 HV(30).

5. A multi-purpose projectile as defined in claim 1 wherein said liquid phase sintered heavy metal sintered material, in the final state of said projectile body, has a highly brittle matrix including at least two different tungsten enriched phases.

6. A multi-purpose projectile as defined in claim 5 wherein, said heavy metal sintered material of the projectile body includes three different tungsten enriched phases in said matrix.

7. A multipurpose projectile as defined in claim 1 wherein: said projectile body composed of heavy metal sintered material is formed of one piece and includes a cylindrical center region, a slightly conically tapered tail region and a truncated conically tapered front region ending in a circular front end surface which extends perpendicular to the longitudinal axis of the projectile and from which extends an essentially cylindrical forwardly oriented pin; said pin, in close proximity to said front end surface, is provided with a circumferential annular groove as an intended break location; and said projectile further includes a conical tip member extending over and fastened to said pin.

8. A multi-purpose projectile as defined in claim 7 wherein said tip member is made of heat treatable steel and is solid.

9. A multi-purpose projectile as defined in claim 7 wherein said tip member is composed of a thin-walled heat treatable steel and is hollow in its interior.

10. A method of forming a projectile body for a multipurpose projectile as defined in claim 1 comprising the steps of:

providing a mixture of tungsten powder, of an average grain size of between 20 $\mu$m and 50 $\mu$m, and cobalt-nickel mixture, with the tungsten percentage being between 90 and 99.5 weight percent and the percentage ratio of cobalt to nickel being between 1:0.5 and 1:2.3;

shaping the mixture of tungsten, cobalt and nickel into a projectile blank of a desired shape;

liquid phase sintering the shaped projectile blank at a temperature between 1450° and 1600° C. for a period of time between 5 and 90 minutes;

finish working the sintered projectile blank to form a projectile body of a desired shape; and thereafter heat treating the finish worked projectile body of sintered material at a temperature of about 900° C. to 1200° C. for a period of time from about 1 to 20 hours.

11. A method as defined in claim 10 wherein: said percentage ratio of cobalt to nickel is between 1:1.2 and 1:1.5.

12. A method as defined in claim 11 wherein said step of sintering is carried out in a hydrogen protective gas atmosphere.

13. A method as defined in claim 11 wherein said step of sintering is carried out at about 1580° C. for between 15 and 30 minutes.

14. A method as defined in claim 11 wherein said step of heat treating the finish worked projectile body is carried out at a temperature between 1000° C. to 1100° C. for a time of about 10 hours.

15. A method as defined in claim 13 further comprising the following step: prior to said step of finish working, subjecting the sintered projectile body to a heat treatment between 1200° and 1400° C., for a period of time from 0.5 to 6 hours, and then rapidly cooling the sintered projectile body.

16. A multi-purpose projectile which, due to its given material structure, disintegrates into fragments when it impacts on the target and encounters even the slightest resistance in the target, said projectile including a sub-caliber, spin stabilized projectile body portion composed of a liquid phase sintered heavy metal sintered material composed essentially of metallic tungsten powder with additives, and a conical nose tip portion fastened to a front end of said projectile body portion, and wherein: said projectile body composed of heavy metal sintered material is made of one piece, and includes a cylindrical center region, a slightly conically tapered tail region, and a conically tapered nose region which ends in a circular frontal end surface lying at a right angle to the longitudinal axis of said projectile and having an essentially cylindrical forwardly oriented pin disposed in its center; said pin is provided with a circumferential annular groove, which serves as the intended break location, in close proximity to said circular front end surface; and said tip portion extends over and is fastened to said pin.

17. A multi-purpose projectile as defined in claim 16, wherein the diameter of said pin is greater than the radius of said circular end surface and is about one-half of the diameter of said cylindrical portion of said projectile body.

18. A multi-purpose projectile as defined in claim 16, wherein said tip portion is made of heat treatable steel and is solid.

19. A multi-purpose projectile as defined in claim 16, wherein said tip portion is composed of a thin-walled heat treatable steel and is hollow in its interior.

20. A multi-purpose projectile as defined in claim 19, wherein a pyrophoric incendiary substance is disposed in the hollow interior of said thin-walled tip portion.

* * * * *